US007980328B2

(12) United States Patent
Hallworth et al.

(10) Patent No.: US 7,980,328 B2
(45) Date of Patent: Jul. 19, 2011

(54) ROTARY STEERABLE DEVICES AND METHODS OF USE

(75) Inventors: John Hallworth, Clifton (GB); Steve Hart, Brimsham Park (GB); Kjell Haugvaldstad, Vanvikan (NO); Laurent Allias, Mezieres les Clery (FR); Bertrand Lacour, Willingham (GB); Riadh Boualleg, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 59 days.

(21) Appl. No.: 12/328,329

(22) Filed: Dec. 4, 2008

(65) Prior Publication Data

US 2010/0139983 A1 Jun. 10, 2010

(51) Int. Cl.
*E21B 7/08* (2006.01)

(52) U.S. Cl. ..... 175/61; 175/73

(58) Field of Classification Search ..... 175/61, 175/62, 73, 76

See application file for complete search history.

(56) References Cited

U.S. PATENT DOCUMENTS

| | | | | |
|---|---|---|---|---|
| 3,298,449 | A * | 1/1967 | Bachman et al. | 175/76 |
| RE29,526 | E * | 1/1978 | Jeter | 175/73 |
| 4,693,328 | A * | 9/1987 | Furse et al. | 175/275 |
| 4,886,130 | A | 12/1989 | Evans | |
| 5,113,953 | A | 5/1992 | Noble et al. | |
| 5,265,682 | A | 11/1993 | Russell et al. | |
| 5,520,255 | A | 5/1996 | Barr et al. | |
| 5,553,678 | A | 9/1996 | Barr et al. | |
| 5,553,679 | A | 9/1996 | Thorp et al. | |
| 5,582,259 | A | 12/1996 | Barr et al. | |
| 5,603,385 | A | 2/1997 | Colebrook et al. | |
| 5,673,763 | A | 10/1997 | Thorp et al. | |
| 5,685,379 | A | 11/1997 | Barr et al. | |
| 5,695,015 | A | 12/1997 | Barr et al. | |
| 5,706,905 | A | 1/1998 | Barr et al. | |
| 5,778,992 | A | 7/1998 | Fuller et al. | |
| 5,803,185 | A | 9/1998 | Barr et al. | |
| 5,971,085 | A | 10/1999 | Colebrook et al. | |
| 6,089,332 | A | 7/2000 | Barr et al. | |
| 6,092,610 | A | 7/2000 | Kosmala et al. | |
| 6,158,529 | A | 12/2000 | Dorel | |
| 6,244,361 | B1 | 6/2001 | Comeau et al. | |
| 6,364,034 | B1 | 4/2002 | Schoeffler | |
| 6,394,193 | B1 | 5/2002 | Askew | |
| 2001/0052428 | A1 | 12/2001 | Larronde et al. | |
| 2002/0001359 | A1 | 1/2002 | Skierszkan et al. | |
| 2006/0131030 | A1 | 6/2006 | Sheffield | |
| 2007/0154341 | A1 | 7/2007 | Saenger | |

OTHER PUBLICATIONS

Schlumberger, "PowerPulse,: High-resolution, real-time logs with fast data transmission" (2008).
Schlumberger, "PowerPulse Services" (2008).
Schlumberger, "Pulse MWD and Vision LWD Services Save USD 1.2 Million" (May 2007).

* cited by examiner

*Primary Examiner* — Kenneth Thompson
(74) *Attorney, Agent, or Firm* — Jeremy Welch; Brigitte Echols

(57) ABSTRACT

The invention provides rotary steerable devices and methods for use of rotary steerable devices. One aspect of the invention provides a rotary steerable device including: a cylinder configured for rotation in a wellbore, the cylinder having a slot and a gauge; and at least one cam received in the slot. The cam is configured for selective actuation between a first position, wherein the cam lies within the gauge of the cylinder, and a second position, wherein the cam is displaced out of the gauge of the cylinder.

15 Claims, 7 Drawing Sheets

ROTARY STEERABLE DEVICES AND METHODS OF USE

TECHNICAL FIELD

The invention provides rotary steerable devices and methods for use of rotary steerable devices.

BACKGROUND

Controlled steering or directional drilling techniques are commonly used in the oil, water, and gas industry to reach resources that are not located directly below a wellhead. The advantages of directional drilling are well known and include the ability to reach reservoirs where vertical access is difficult or not possible (e.g. where an oilfield is located under a city, a body of water, or a difficult to drill formation) and the ability to group multiple wellheads on a single platform (e.g. for offshore drilling).

With the need for oil, water, and natural gas increasing, improved and more efficient apparatus and methodology for extracting natural resources from the earth are necessary.

SUMMARY OF THE INVENTION

The invention provides rotary steerable devices and methods for use of rotary steerable devices.

One aspect of the invention provides a rotary steerable device including: a cylinder configured for rotation in a wellbore, the cylinder having a slot and a gauge; and at least one cam received in the slot. The cam is configured for selective actuation between a first position, wherein the cam lies within the gauge of the cylinder, and a second position, wherein the cam is displaced out of the gauge of the cylinder.

This aspect can have several embodiments. The cam can be utilized in displacing the cylinder for steering the rotary steerable device. The rotary steerable device can include an actuator configured to actuate the cam. The actuator can be a low power actuator. The actuator can be an electric motor. The actuator can be a hydraulic actuator. The rotary steerable device can include a controller configured to control actuation of the cam by the actuator.

The rotary steerable device can include a drill bit. The drill bit can be substantially adjacent to the cam. The cam can rotate in a first direction about a rotational axis. The cam can be configured to rotate in a second direction about the rotational axis after contact with the wellbore. The cylinder can rotate in a direction opposite to the first direction of rotation of the cam. The cam can be configured for actuation to an angle at which a non-slip condition occurs when the cylinder is rotated.

The rotary steerable device can include a cam shaft extending from the cam along the rotational axis of the cam. The rotary steerable device can include a plurality of bearings for supporting the cam shaft. The rotary steerable device can include a wear ring external to the cylinder. The wear ring can be configured for displacement when contacted by the cam. The cylinder can include a plurality of slots. A cam can be received in each slot.

Another aspect of the invention provides a rotary steerable device including: a cylinder configured for rotation in a wellbore, the cylinder having a slot; and a plurality of cams received in the slot. Each cam is configured for selective actuation between a first position wherein at least one of the cams lies within a gauge of the cylinder, and a second position, wherein at least one of the cams is displaced out of a gauge of the cylinder.

Another aspect of the invention provides a method of steering a bottom hole assembly. The method includes: providing a bottom hole assembly including a cylinder configured for rotation in a wellbore, the cylinder having a slot, and at least one cam received in the slot, the cam configured for selective actuation from a first position, wherein the cam lies within a gauge of the cylinder, and a second position, wherein the cam is displaced out of a gauge of the cylinder; rotating the cylinder; and selectively actuating the cam to steer the bottom hole assembly.

This aspect can have several embodiments. The bottom hole assembly can include a wear ring external to the cylinder. The wear ring can be configured for displacement when contacted by the cam.

Another aspect of the invention provides a wellsite system including: a drill string; a kelly coupled to the drill string; a rotary steerable device coupled to the drill string; and a drill bit coupled to the drill string. The rotary steerable device includes: a cylinder configured for rotation in a wellbore, the cylinder having a slot and a gauge; and at least one cam received in the slot, the cam configured for selective actuation between a first position, wherein the cam lies within the gauge of the cylinder, and a second position, wherein the cam is displaced out of the gauge of the cylinder.

DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DETAILED DESCRIPTION OF THE INVENTION

The invention provides rotary steerable devices and methods for use of rotary steerable devices. Some embodiments of the invention can be used in a wellsite system.

Wellsite System

Figure 1:
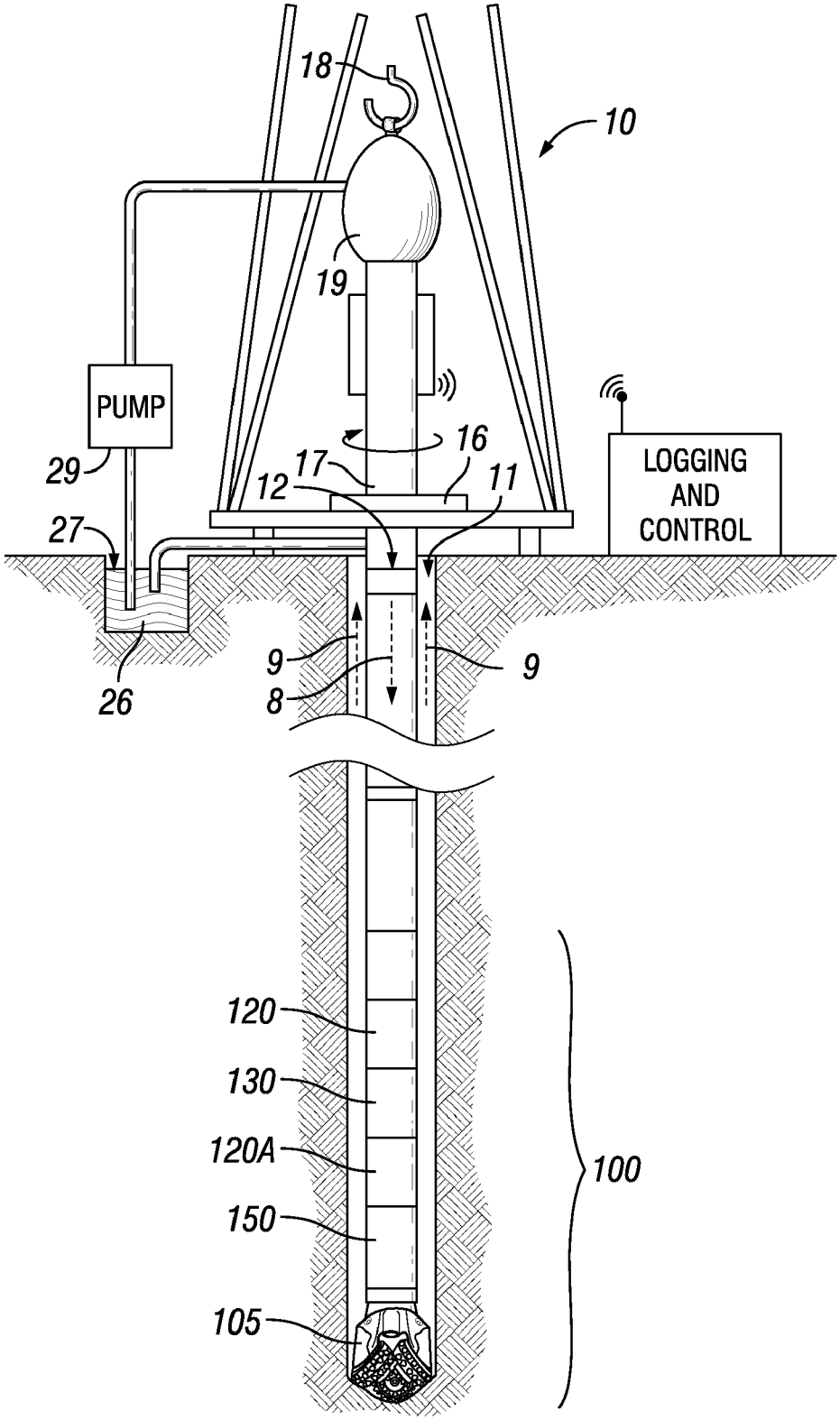
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly (BHA) 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator (also known as a "mud motor") powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction.

Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well.

A directional drilling system may also be used in vertical drilling operation as well. Often the drill bit will veer off of a planned drilling trajectory because of the unpredictable nature of the formations being penetrated or the varying forces that the drill bit experiences. When such a deviation occurs, a directional drilling system may be used to put the drill bit back on course.

A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems.

In the point-the-bit system, the axis of rotation of the drill bit is deviated from the local axis of the bottom hole assembly in the general direction of the new hole. The hole is propagated in accordance with the customary three-point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953.

In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form, the drill bit is required to cut side ways in order to generate a curved hole. Examples of push-the-bit type rotary steerable systems and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; and 5,971,085.

Rotary Steerable Devices

Figure 2A:
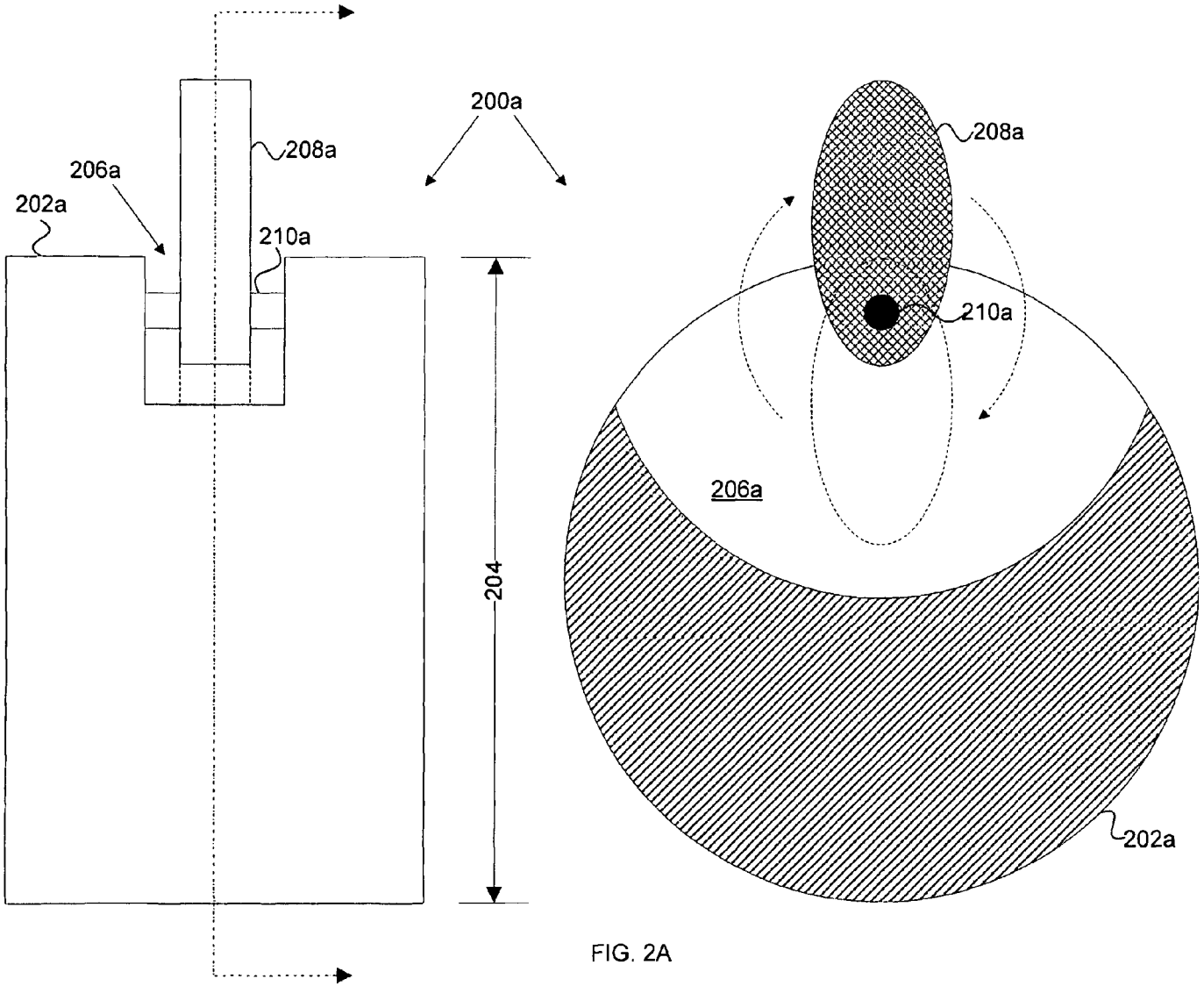
FIG. 2A illustrates a rotary steerable device in a side and cross-sectional view according to one embodiment of the invention.

FIG. 2A depicts a rotary steerable device 200*a* in a side and cross-sectional view according to one embodiment of the invention. The invention includes a cylinder 202*a* having a gauge 204*a* and a slot 206*a*. A cam 208*a* is received within the slot 206*a*. The cam 208*a* can rotate about a pin 210*a*, as depicted by the dashed lines.

Figure 2B:
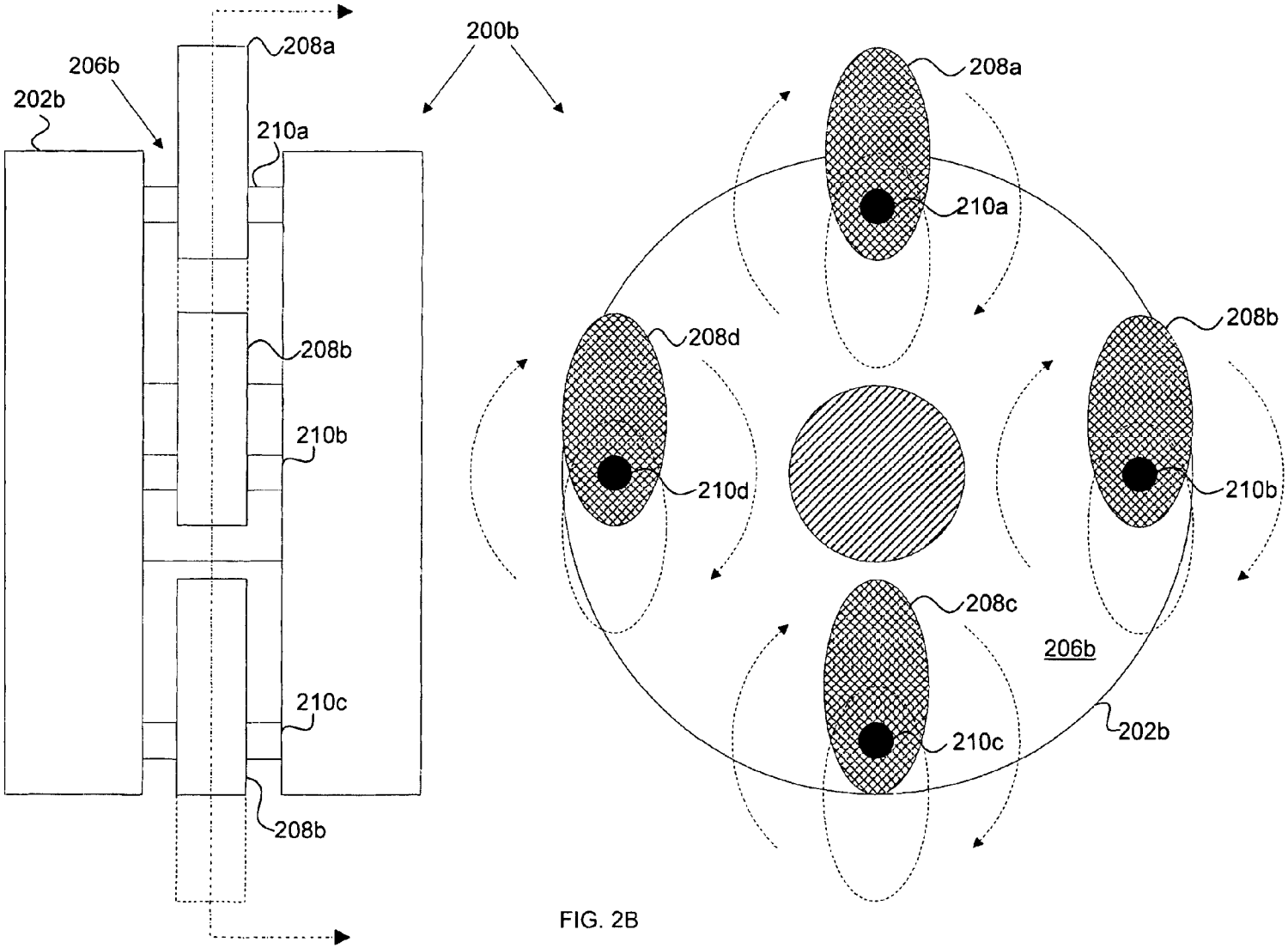
FIG. 2B illustrates another embodiment of the invention that includes a continuous slot.

FIG. 2B depicts another embodiment of the invention that includes a continuous slot 206*b*. Four cams 208*a*, 208*b*, 208*c*, 208*d* are received within slot 206*b*.

In some embodiments, steering device 200 includes between three and five cams 208. Although cams 208*a*, 208*b*,

208*c*, and 208*d* are arranged in a single plane in FIG. 2B, the invention is not limited to such an embodiment. Rather, multiple cams 208 can be arranged in adjacent planes.

Figure 3A:
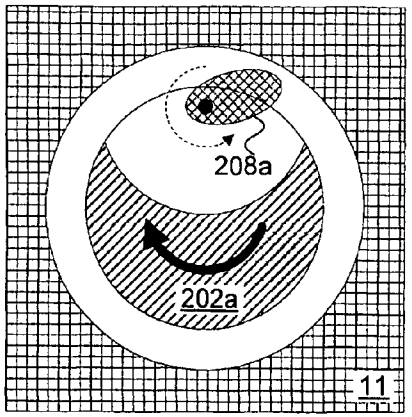
FIGS. 3A-3F illustrates the operation of a rotary steerable device within a borehole to steer a drill bit coupled to the rotary steerable device according to one embodiment of the invention.
Figure 3B:
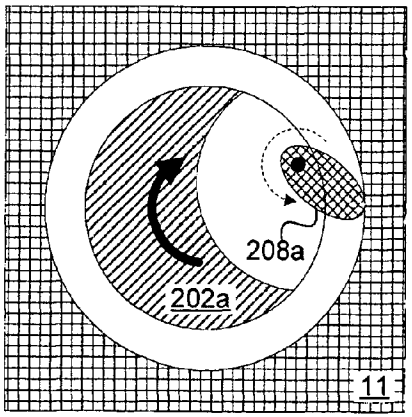
Figure 3C:
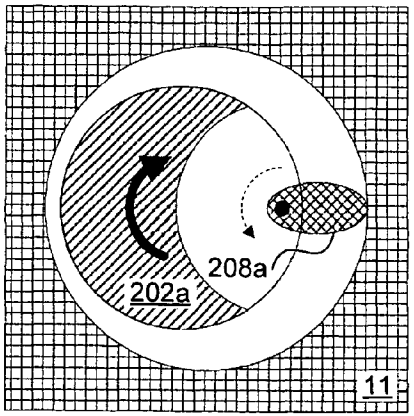
Figure 3D:
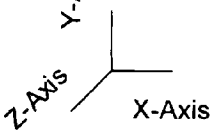
Figure 3D:
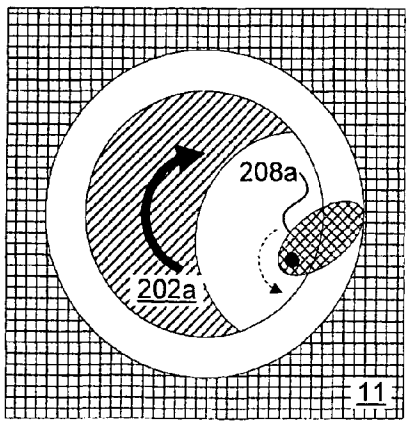
Figure 3E:
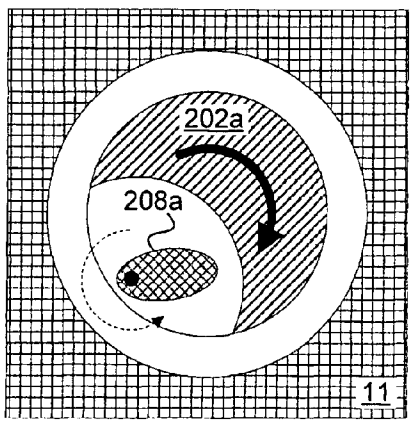
Figure 3F:
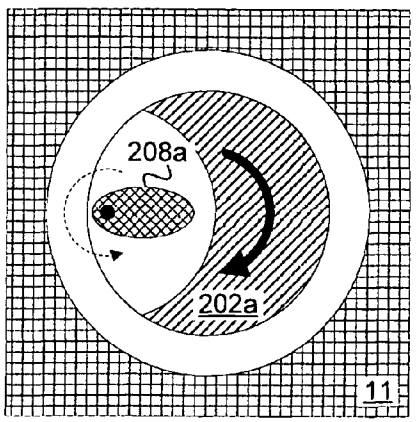

FIGS. 3A-3F depict the operation of the rotary steerable device 200*a* within a borehole 11 to steer a drill bit coupled to the rotary steerable device 200*a* in a negative x direction. In FIG. 3A, cylinder 202*a* is rotated in a clockwise direction, while cam 208*a* rotates in a counterclockwise direction. In FIG. 3B, as the cylinder 202*a* and the cam 208*a* continue to rotate in their respective directions cam, 208*a* is brought into contact with the borehole 11. Although the cam 208*a* may initially slide against the borehole 11, at a certain point, the angle of cam 208*a* with respect to the borehole 11 increases so that a "non-slip" condition is created and the cam "grips" the borehole 11. In FIG. 3C, cam 208*a* is rotated to a fully extended position while the cam still grips the borehole 11. The rotational inertia of the steering device 200 and the BHA causes the cam 208*a* to rotate around its center of rotation (i.e. the point of contact with the borehole 11), which pushes the rotary steerable device 200*a* and a drill bit coupled to the rotary steerable device 200*a* in a negative x direction. In FIGS. 3D-3F, the cylinder 202*a* and the cam 208*a* continue to rotate in their respective directions before returning to position depicted in FIG. 3A.

Figure 4:
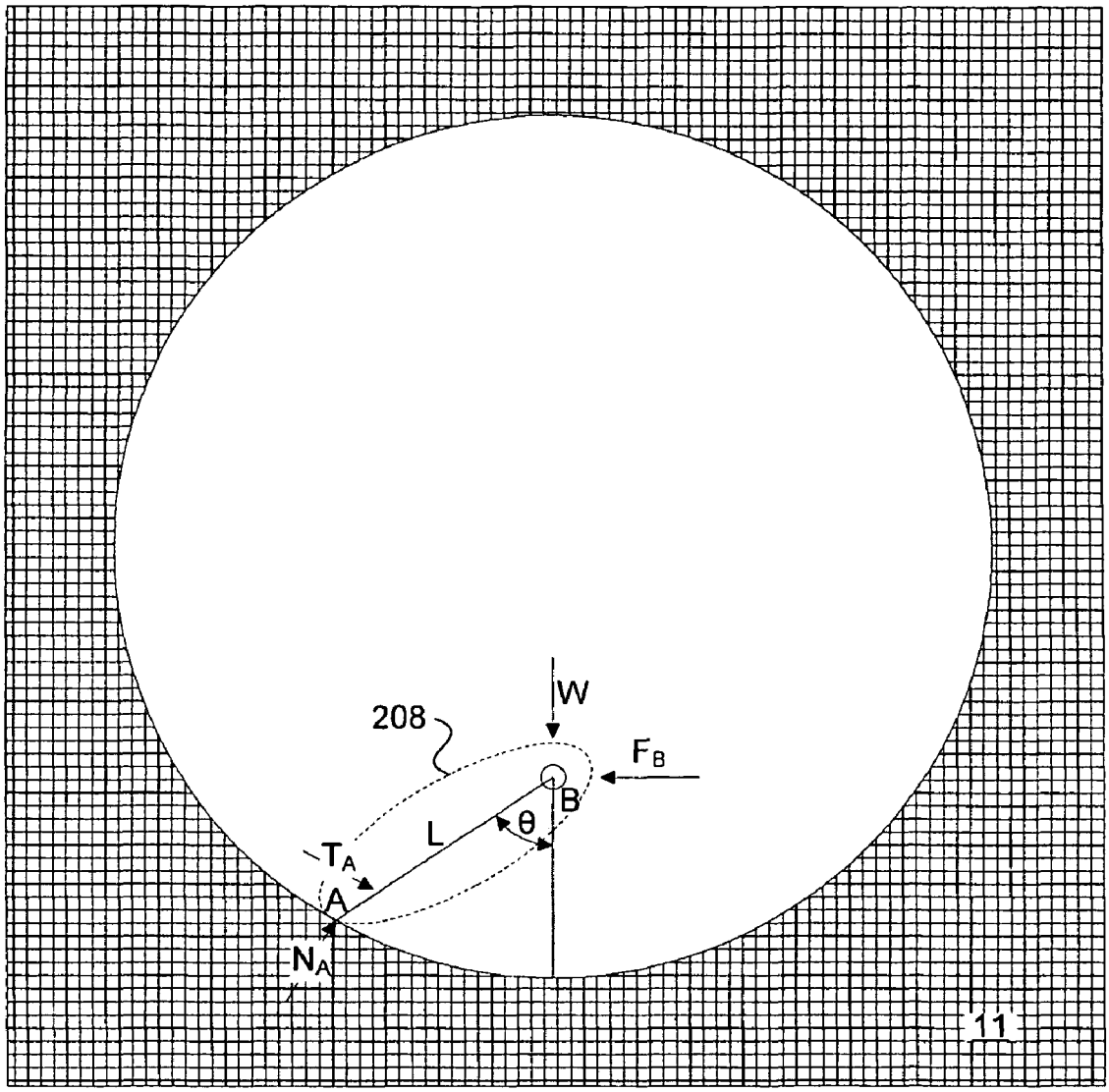
FIG. 4 illustrates a model of the interaction between a cam and a borehole according to one embodiment of the invention.

FIG. 4 depicts a model of the interaction between the cam 208 and borehole 11. W represents the weight applied through the center of rotation of the cam 208. $T_A$ represents the friction force. $N_A$ represents the normal force. $F_B$ represents the force on the on the center of rotation of the cam 208. θ represents the angle between the force vector Wand the line formed between the point of contact A (between the cam 208 and the borehole 11) and the rotational axis of cam 208. L represents the distance between the point of contact A (between the cam 208 and the borehole 11) and the rotational axis of cam 208 (i.e. the distance between points A and B).

Forces W and $N_A$, and forces $T_A$ and $F_B$ balance each other. The moment of equilibrium about point B can be expresses as follows:

$$T_A L \cos\theta - N_A L \sin\theta = 0.$$

Rearranging for $T_A$ and substituting W for $N_A$ yields:

$$T_A = W \tan\theta.$$

According to Coulombs's Friction Law, a non-slip condition will occur when $T_A < \mu N_A$ and a slip condition will occur when $T_A = \mu N_A$, wherein μ is the coefficient of friction between the borehole 11 and the cam 208. Accordingly, an angle that will produce a non-spip condition, i.e., an angle at which the cam 208 grips the borehole 11, can be calculated as follows:

$$W \tan\theta \leqq \mu N_A$$

$$\tan\theta \leqq \mu$$

$$\theta_{grip} \leqq \tan^{-1}\mu.$$

This model predicts that the grip angle is dependent on the coefficient of friction between the cam 208 and borehole 11. The greater the coefficient of friction, the greater the angle through which the cam will grip the formation. The grip angle could be improved by adding teeth or other aggressive structures or surfaces (e.g. roughened, milled, knurled surfaces) to the cam 208 to better grip the borehole 11. Additionally or alternatively, a layer of non-slip and/or compressive materials (e.g. rubber) can be applied to the contacting surface of the cam.

The profile of the cam and the distance of the cam's rotational axis from the rotational axis of the steering device 200 (and the BHA) will determine the distance that the steering device 200 (and the BHA) is displaced due to the cam deployment. The profile of the cam will also determine the time that the BHA is displaced. Ideally, the displacement time is maximized while the displacement acceleration (and therefore shock loading) is minimized.

Figure 5:
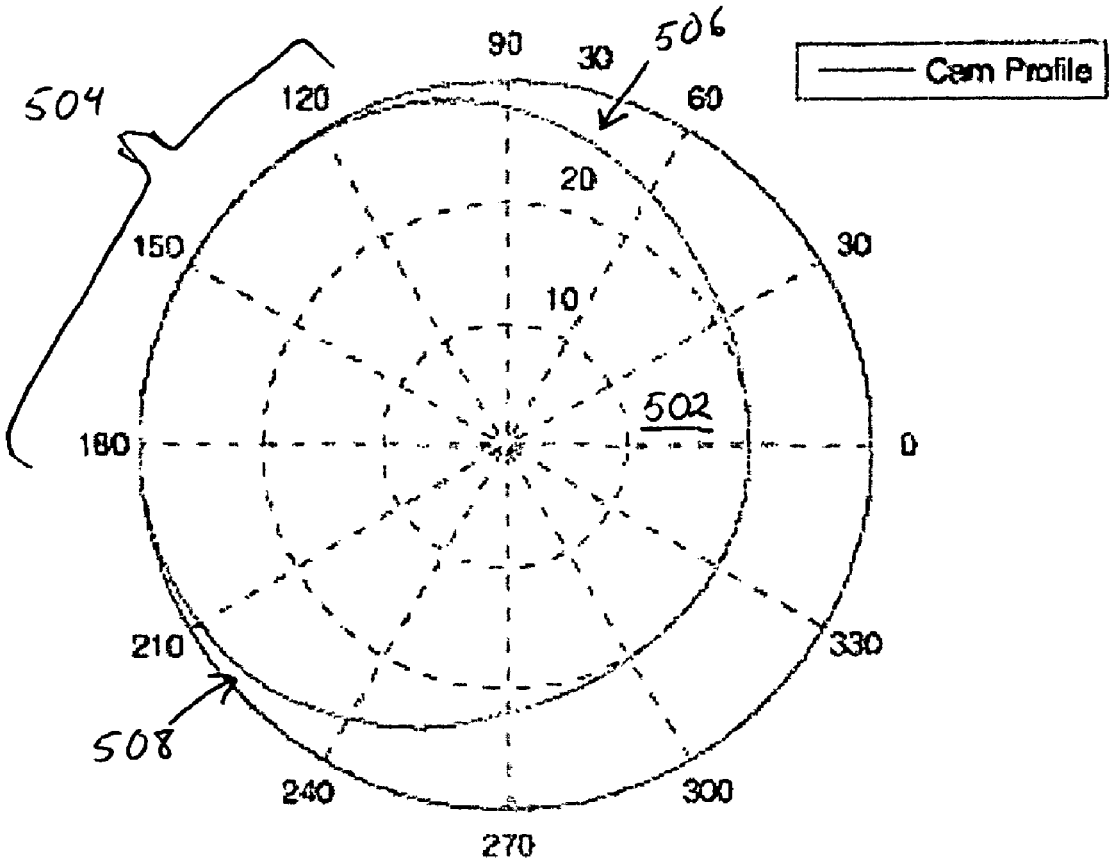
FIG. 5 illustrates a profile of an exemplary cam for incorporation within a rotary steerable device according to one embodiment of the invention.

FIG. 5 depicts a profile of an exemplary cam 502 for incorporation within the rotary steerable device 200. The cam 502 has a long top dwell section 504 to maximize the displacement time and smooth rise and fall sections 506, 508 to reduce the acceleration imparted on the BHA. While smaller cams will allow a greater cross sectional area however, larger cams will allow greater BHA displacement time windows which will ultimately provide greater steering performance.

Each cam 208 is coupled with a pin 210. The cam 208 and pin 210 can be machined from a single piece of material. Alternatively, the cam 208 and pin 210 can be joined by a key, a Woodruff key, a spline, welding, brazing, adhesive, mechanical fasteners, bolts, screws, nails, press fitting, friction fitting, and the like. As will be appreciated, the pin 210 will be loaded in shear, and therefore should of a sufficient material and dimension to withstand such forces. Suitable materials for the cam 208 and/or pin 210 include steel, "high speed steel", carbon steel, brass, copper, iron, polycrystalline diamond compact (PDC), hardface, ceramics, carbides, ceramic carbides, cermets, and the like.

In some embodiments, slot 206 is dimensioned to minimize the clearance between the edges of the slot and cam 208. A minimal clearance will reduce the accumulation of drilling cuttings in the slot and reduce the occurrence of jamming.

In a neutral mode, the cam(s) 208 remains within the gauge 204 of the rotary steerable device 200. The cam 208 can be held by some mechanism so that it will not be deployed by mud flow as the rotary steerable device 200 rotates with the rest of the BHA. The cam 208 can be actuated by electrical, mechanical, electromechanical, hydraulic, and/or pneumatic devices, and the like. For example, a mud motor can generate electricity and/or mechanical force to rotate the pin(s) 210 and cam(s) 208.

Rotary steerable device 200 can further include a control unit (not depicted) for selectively actuating steering devices cam(s) 208. Control unit maintains the proper angular position of the cam(s) 208 relative to the cylinder 202 and/or subsurface formation of the borehole 11. In some embodiments, control unit is mounted on a bearing that allow control unit to rotate freely about the axis of the cylinder 202. The control unit, according to some embodiments, contains sensory equipment such as a three-axis accelerometer and/or magnetometer sensors to detect the inclination and azimuth of the bottom hole assembly. The control unit can further communicate with sensors disposed within elements of the bottom hole assembly such that said sensors can provide formation characteristics or drilling dynamics data to control unit. Formation characteristics can include information about adjacent geologic formation gathered from ultrasound or nuclear imaging devices such as those discussed in U.S. Patent Publication No. 2007/0154341, the contents of which is hereby incorporated by reference herein. Drilling dynamics data can include measurements of the vibration, acceleration, velocity, and temperature of the bottom hole assembly.

In some embodiments, control unit is programmed above ground to following an desired inclination and direction. The progress of the bottom hole assembly can be measured using MWD systems and transmitted above-ground via a sequences of pulses in the drilling fluid, via an acoustic or wireless transmission method, or via a wired connection. If the desired path is changed, new instructions can be transmitted as required. Mud communication systems are described in U.S.

Patent Publication No. 2006/0131030, herein incorporated by reference. Suitable systems are available under the POWER-PULSE™ trademark from Schlumberger Technology Corporation of Sugar Land, Tex.

The rotary steerable device 200 is ideally positioned in close proximity to drill bit 105. For example, the rotary steerable device 200 can be integrated with either drill bit 105 or roto-steerable subsystem 150 as depicted in FIG. 1. Positioning the rotary steerable device 200 close to the drill bit 105 maximizes the steering force on drill bit 105 to more effectively "push the bit".

Figure 6:
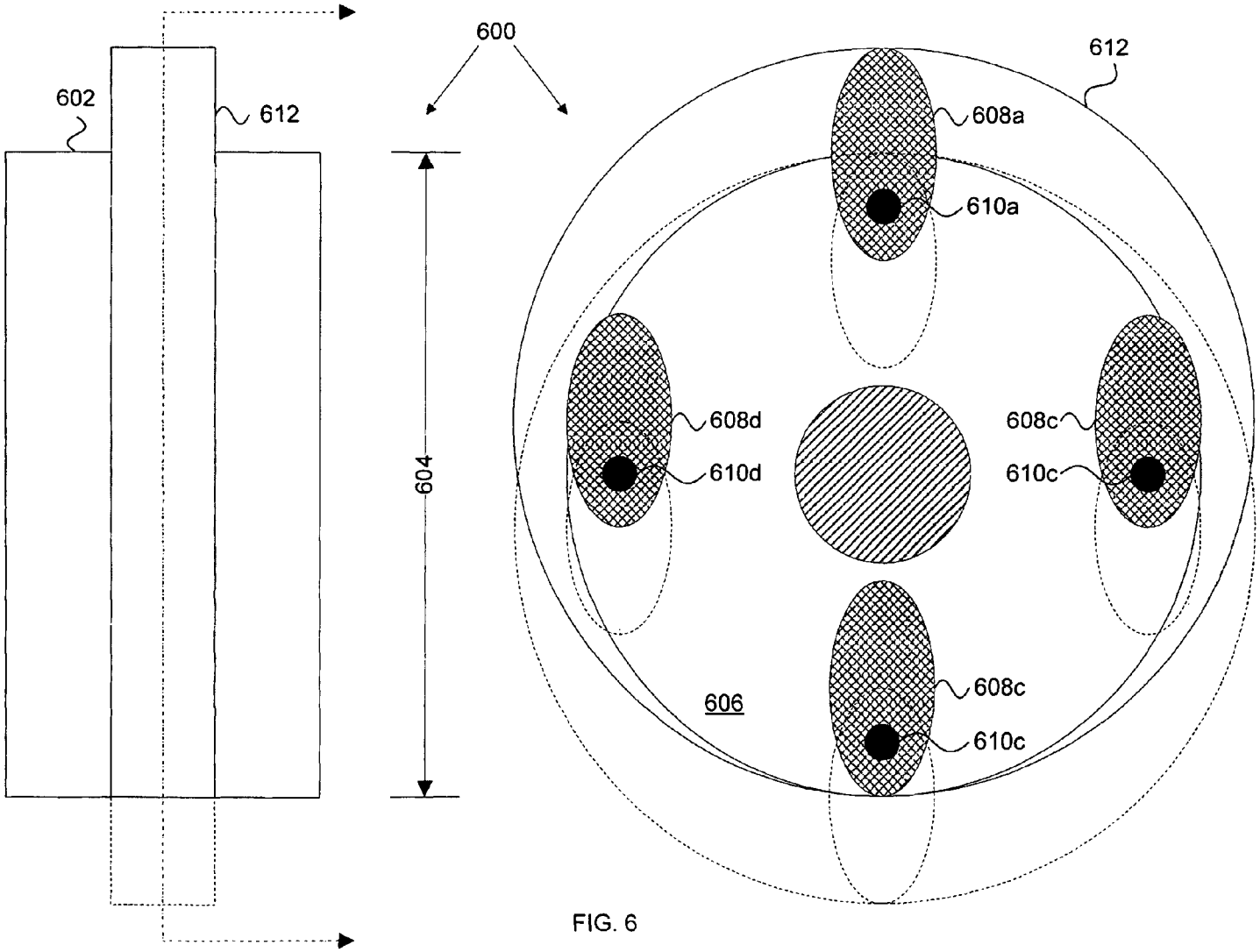
FIG. 6 illustrates a rotary steerable device including a wear ring surrounding a plurality of cams according to one embodiment of the invention.

Referring to FIG. 6, another embodiment of the invention provides a rotary steerable device 600 including a wear ring 612 surrounding cams 608*a*, 608*b*, 608*c*, 608*d*. Wear ring 612 allows for continuous and/or increased contact with borehole 11. Suitable materials for the wear ring include steel, "high speed steel", carbon steel, brass, copper, iron, polycrystalline diamond compact (PDC), hardface, ceramics, carbides, ceramic carbides, cermets, and the like.

Wear ring 612 can be rigid or flexible. A rigid ring can, for example, be fabricated by molding, casting, machining, and the like. A flexible ring can be flexible due to the nature of the material (e.g. rubber, para-arimid fabrics) or can be flexible due to the design of the wear ring (e.g. a wear ring having a plurality of hinged links).

Wear ring 612 can minimize wear of cams 608*a*, 608*b*, 608*c*, 608*d* and can minimize the infiltration of drilling cuttings into slot 606. To further inhibit the infiltration of drilling cuttings, the volume defined by wear ring 612 can be packed with a grease. Additionally or alternatively, a gasket (e.g. a rubber gasket) can be attached to the exterior of cylinder 602 and wear ring 612 to prevent infiltration of drilling cuttings and/or maintain proper lubrication of cams 608*a*, 608*b*, 608*c*, 608*d*.

The invention provided herein represents a significant improvement over conventional steering devices. The rotary steerable devices provided herein utilize relatively low amounts of power, which can easily be generated in the bottom hole assembly. Moreover, most of the force utilized to steer the bottom hole assembly is generated by the rotational forces of the bottom hole assembly.

Finally, modeling of invention suggests that small deflections provide very effective steering when the rotary steerable device is located near the drill bit. According to one model, a displacement of a cam out of gauge by 0.2 mm will produce a dogleg of 10.8 degrees over 30 meters.

INCORPORATION BY REFERENCE

All patents, published patent applications, and other references disclosed herein are hereby expressly incorporated by reference in their entireties by reference.

EQUIVALENTS

Those skilled in the art will recognize, or be able to ascertain using no more than routine experimentation, many equivalents of the specific embodiments of the invention described herein. Such equivalents are intended to be encompassed by the following claims.

The invention claimed is:

1. A rotary steerable device comprising:

a cylinder configured for rotation in a wellbore, the cylinder having a slot and a gauge; and at least one cam received in the slot, the at least one cam having a rotational axis at a cam pin which is radially offset from a rotational axis of the rotary steerable device, the cam being selectively actuatable by rotation about the cam pin between a first position, wherein the cam lies within the gauge of the cylinder, and a second position, wherein the cam is displaced out of the gauge of the cylinder.

2. The rotary steerable device of claim 1, wherein the cam is utilized in displacing the cylinder for steering the rotary steerable device.

3. The rotary steerable device of claim 1, further comprising:

a drill bit, wherein the drill bit is substantially adjacent to the cam.

4. The rotary steerable device of claim 1, wherein the cam rotates in a first direction about a rotational axis.

5. The rotary steerable device of claim 4, wherein the cam is configured to rotate in a second direction about the rotational axis after contact with the wellbore.

6. The rotary steerable device of claim 4, wherein the cylinder rotates in a direction opposite to the first direction of rotation of the cam.

7. The rotary steerable device of claim 1, wherein the cam is configured for actuation to an angle at which a non-slip condition occurs when the cylinder is rotated.

8. The rotary steerable device of claim 1, further comprising:

a cam shaft extending from the cam along the rotational axis of the cam.

9. The rotary steerable device of claim 8 further comprising:

a plurality of bearings for supporting the cam shaft.

10. The rotary steerable device of claim 1, further comprising:

a wear ring external to the cylinder, the wear ring configured for displacement when contacted by the cam.

11. The rotary steerable device of claim 1, wherein the cylinder has a plurality of slots, and wherein a cam is received in each slot.

12. A rotary steerable device comprising:

a cylinder configured for rotation in a wellbore, the cylinder having a slot; and a plurality of cams received in the slot, each cam having a rotational axis at a cam pin which is radially offset from a rotational axis of the rotary steerable device, each cam being selectively actuatable by rotation about the cam pin, the rotation moving a cam dwell section between a first position, wherein at least one of the cams lies within a gauge of the cylinder, and a second position, wherein at least one of the cams is displaced out of a gauge of the cylinder.

13. A method of steering a bottom hole assembly comprising:

providing a bottom hole assembly comprising:

a cylinder configured for rotation in a wellbore, the cylinder having a slot; and at least one cam received in the slot, the cam configured for selective actuation by rotation about a cam pin radially offset from a rotational axis of the bottom hole assembly from a first position, wherein the cam lies within a gauge of the cylinder, and a second position, wherein the cam is displaced out of a guage of the cylinder;

rotating the cylinder; and selectively actuating the cam to steer the bottom hole assembly.

14. The method of claim 13, wherein the bottom hole assembly further comprises:

a wear ring external to the cylinder, the wear ring configured for displacement when contacted by the cam.

15. A wellsite system comprising:

a drill string;

a kelly coupled to the drill string;

a rotary steerable device coupled to the drill string, the rotary steerable device comprising:

a cylinder configured for rotation in a wellbore, the cylinder having a slot and a gauge; and at least one cam received in the slot, the at least one cam having a rotational axis at a cam pin which is radially offset from a rotational axis of the rotary steerable device, the cam being selectively actuatable by rotation about the cam pin between a first position, wherein the cam lies within the gauge of the cylinder, and a second position, wherein the cam is displaced out of the gauge of the cylinder; and a drill bit coupled to the drill string.

* * * * *